US005370957A

United States Patent [19]

Nishikiori et al.

[11] Patent Number: 5,370,957

[45] Date of Patent: Dec. 6, 1994

[54] ELECTROSTATIC DEVELOPER AND ELECTROSTATIC DEVELOPING METHOD

[75] Inventors: Takuya Nishikiori, Yokohama; Hiromi Horiuchi; Masayuki Hiroi, both of Tokyo, all of Japan

[73] Assignee: Mitsubishi Kasei Corporation, Tokyo, Japan

[21] Appl. No.: 76,914

[22] Filed: Jun. 15, 1993

[30] Foreign Application Priority Data

Jun. 16, 1992 [JP] Japan ..... 4-157002

[51] Int. Cl.[5] ..... G03G 9/107

[52] U.S. Cl. ..... 430/106.6; 430/120

[58] Field of Search ..... 430/106.6, 106, 120

[56] References Cited

U.S. PATENT DOCUMENTS 3,866,574 2/1975 Hardenbrook ..... 118/637
4,568,625 2/1986 Uchiyama et al. ..... 430/120
5,112,714 5/1992 Imai et al. ..... 430/106.6

FOREIGN PATENT DOCUMENTS 50-45639 4/1975 Japan .
55-18656 8/1980 Japan .
58-100869 6/1983 Japan .
63-13967 6/1988 Japan .

*Primary Examiner*—John Goodrow
*Attorney, Agent, or Firm*—Ladas & Parry

[57] ABSTRACT

Disclosed herein are an electrostatic developer comprising image-forming particles which are magnetic, conductive particles having an average particle size of not more than that of the image-forming particles and more than 0.1 μm, and particles obtainable by subjecting insulative inorganic oxide particles having a frictional charging polarity opposite to that of the image-forming particles to a hydrophobic treatment with silicone; and an electrostatic developing method in which the developer is used.

15 Claims, 1 Drawing Sheet

ELECTROSTATIC DEVELOPER AND ELECTROSTATIC DEVELOPING METHOD

BACKGROUND OF THE INVENTION

The present invention relates to an electrostatic developer and an electrostatic developing method for use in electrophotography, electrostatic recording or the like.

Heretofore, as a developing method and a developer for use in electrostatic development in electrophotography or the like, there have been known, for example, a two-component developing method by using as a developer a mixture of nonmagnetic image-forming particles and magnetic particles having a larger particle size than that of the image-forming particles, a one-component developing method by using a developer comprising only magnetic image-forming particles or magnetic image-forming particles and a small amount of additive particles, and a developing method by using a developer comprising magnetic particles having a larger particle size than that of the image-forming particles and the above-mentioned one-component developer.

In the said magnetic one-component developing method and developing method of using as a developer the mixture of the magnetic image-forming particles and magnetic particles of the larger particle size than that of the image-forming particles, there has been known a method of moving a permanent magnet in which N poles and S poles are disposed alternately at the back face of a developer-carrying member, thereby delivering the developer and at the same time, periodically decreasing the magnetic attraction force of the image-forming particles to the direction of the carrying member under an alternating (oscillating) magnetic field caused by the movement of the permanent magnet in a region opposed to an electrostatic latent image-retaining member, thereby improving the developability to the latent image-retaining member (for example, refer to Japanese Patent Application Laid-Open (KOKAI) Nos. 50-45639(1975) and 58-100869(1983)); a method of reciprocally moving charged image-forming particles under an alternating (oscillating) electric field formed by an AC voltage applied between a latent image-retaining member and a developer-carrying member (for example, refer to U.S. Pat. No. 3,866,574 and Japanese Patent Application Laid-Open (KOKAI) No. 55-18656(1980)); or a method in which both of the systems are used together.

However, the developing method under the alternating electric field involves a drawback of also promoting the generation of oppositely charged image-forming particles and transfer of the oppositely charged image-forming particles to a non-image area of a latent image-retaining member. In the alternating electric field, since the developer tends to be exposed to a stronger electric field as compared with that under a static electric field, charge transfer between the image-forming particles may be promoted to generate oppositely charged image-forming particles.

Further, upon development under the alternating electric field or alternating magnetic field, since the attracting force to the direction of the developer-carrying member is reduced, oppositely charged image-forming particles which are charged relatively weakly and which can not transfer upon development under a static field or static magnetic field, are also transferred easily. Transfer of the image-forming particles to the non-image area causes to an undesirable phenomenon in view of image quality as a so-called "fogging", in which black spots are formed in the white area of images. In a copying machine in which developed image-forming particles on a latent image-retaining member are electrostatically transferred to a transfer material such as paper and images are finally visualized, the image-forming particles in the non-image area are not sometimes transferred to the transfer material because they are charged oppositely. In such case, since more image-forming particles than required are consumed, this is an undesirable phenomenon.

Further, imbalance occurs between the front and rear ends of images depending on the moving direction of a developing sleeve or magnet. According to the result of an experiment made by the present inventors, in a usual magnetic one-component developing method in which the developing sleeve is moved in the same direction as movement of the latent image-retaining member while the magnet is moved in a reverse direction to movement of the latent image-retaining member in an opposed region between the latent image-retaining member and the developing sleeve (developer-carrying member), "underdevelopment of front edge" in which uniform image density is difficult to be formed and front ends of solid images are disturbed, or "overdevelopment of rear edge" in which rear ends of the solid images are excessively developed is caused. In addition, also in the development of fine line images, image-forming particles scatter around the periphery of fine lines, whereby the development only with low resolution power and low image quality arises.

As a result of the present inventors' earnest studies for overcoming the foregoing problems, it has been found that by using a developer composed of conductive particles having a specific average particle size and particles having a specific charge property and subjected to a specific surface treatment, a development at high resolution power with no transfer of oppositely charged image-forming particles to a non-image area, with high density and clear images and without the unnecessary consumption of image-forming particles in electrophotography, electrostatic recording or the like is attained. The present invention has been accomplished based on the finding.

SUMMARY OF THE INVENTION in a first aspect of the present invention, there is provided an electrostatic developer comprising image-forming particles which are magnetic, conductive particles having an average particle size of not more than that of the image-forming particles and more than 0.1 μm, and particles obtainable by subjecting insulative inorganic oxide particles having a frictional charging polarity opposite to that of the image-forming particles to a hydrophobic treatment with silicone.

In a second aspect of the present invention, there is provided an electrostatic developing method comprising opposing a surface of a latent image-retaining member on which an electrostatic latent image is formed, to a surface of a developer-carrying member on which the electrostatic developer as defined in the first aspect is carried; placing the opposed region in an alternating magnetic field, alternating electric field or both thereof which exerts substantially in perpendicular to the surface of the developer-carrying member in the said opposed region; and transferring the image-forming particles in the developer onto the latent image-retaining member.

DETAILED DESCRIPTION OF THE INVENTION

Figure 1:
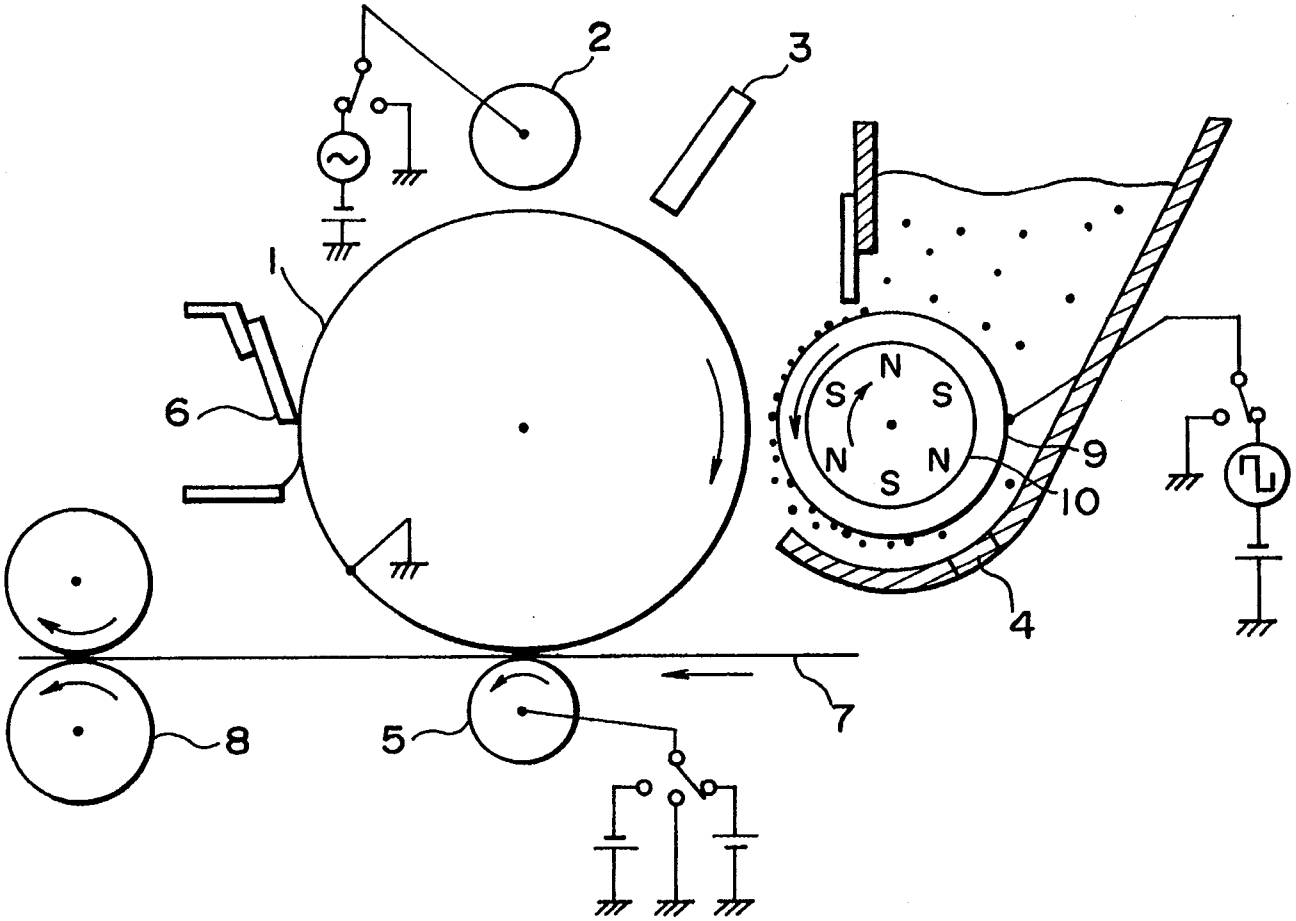
FIG. 1 shows an example of an explanatory view of an image-forming apparatus for using an electrostatic developer according to the present invention.

The latent image-retaining member (carrier) usable in the present invention includes a light sensitive member having a layer, for example, made of CdS or an organic light sensitive material, etc. disposed on a conductive substrate or a light sensitive member having an insulative layer disposed on a conductive substrate (master). A desired electrostatic latent image pattern is formed by an electrostatic charge distribution on the surface of the latent image-retaining member, the latent images are passed through a region opposed to the developer-carrying member and a developer is electrostatically transferred onto the latent image-retaining member.

The developer-carrying member used in the present invention is composed of a non-magnetic conductive material. The member has a thickness so that a magnetic field generated by a magnetic field generation means disposed at the surface of the developer-carrying member which is back of the surface opposed to the latent image-retaining member, can provide a sufficient magnetic field intensity to penetrate the member and to carry the developer, as well as sufficient mechanical strength of the member is provided. The developer-carrying surface may be subjected to an oxidation treatment, a surface coating treatment such as a resin coating or a roughening treatment such as sand blast. Usually, the developer-carrying member moves at a constant velocity for successively delivering the developer to a region opposed to the latent image-retaining member. Alternatively, the developer may be delivered by utilizing an attracting force of an alternating magnetic field generated by the magnetic field generation means at the back face while keeping the member stationary. A gap between the latent image-retaining member and the developer-carrying member is preferably 0.15 to 1.5 mm.

The alternating magnetic field generation means for use in the present invention includes a means of generating an alternating magnetic field substantially in perpendicular to the surface of the developer-carrying member by moving N and S poles of magnets along the back face of the developer-carrying member, thereby delivering the developer and at the same time, periodically reducing the magnetic attracting force of the image-forming particles in the direction to the developer-carrying member. Usually, an alternating magnetic field is generated by using a permanent magnet having a plurality of N- and S-poles disposed alternately and moving them at a constant velocity along the back face of the developer-carrying member, but the alternating magnetic field may be also be generated by supplying an alternating current to a fixed electromagnet.

The developer-carrying member and the electric field generation means may be those employed, for example, in usual copying machines. For example, by using a magnetic field generation means comprising a developer-carrying member having a cylindrical sleeve and a columnar permanent magnet roll incorporated coaxially in the developer-carrying member and magnetized alternately to N- and S-poles on the circumference, a developer carried on the outer circumferential surface of the sleeve is delivered by rotating the sleeve and the permanent magnet roll relative to each other, and an alternating magnetic field is generated in a region opposed to the latent image-retaining member. The alternating cycles of the alternating magnetic field depends on the processing speed of the development and the magnetic field intensity and it is usually selected to an optimum point within a range from 10 to 600 cycles/sec.

The alternating electric field substantially in perpendicular to the surface of the carrying member used in the present invention is generated by applying a DC voltage and an AC voltage being superposed with each other between the conductive substrate of the latent image-retaining member and the developer-carrying member. The alternating voltage may be a sinusoidal wave, a rectangular wave, a trigonal wave or a wave synthesized from such waves of different frequencies and different waveforms. Usually, the amplitude of the alternating voltage is from 400 V to 3 kV. The frequency for the AC voltage is usually within a range from 100 Hz to 10 kHz.

The alternating electric field generation means may be combined with the alternating magnetic field generation means described above or a static magnetic field generation means.

As an example of the static magnetic field generation means, there can be mentioned a permanent magnet which is fixed and disposed on the back face of the developer-carrying member.

The developer used in the present invention contains magnetic image-forming particles and particles subjected to a hydrophobic treatment with silicone, and also contains inorganic conductive particles having a particle size of smaller than that of the image-forming particles for further improving the resolution power. In addition, fluidity-improving particles employed usually or carrier particles having a particle size of larger than the image-forming particles may also be contained as developer component.

As the image-forming particles in the present invention, a magnetic toner comprising a magnetic powder and a binder resin as the essential ingredient is usually used. The blending weight ratio of the binder resin to the magnetic powder can be selected within a range from 1:3 to 7:1, while taking the fixing property to a transfer material into consideration. The toner is a powder having an average particle size usually from 4 to 20 μm, preferably, from 5 to 15 μm obtained by kneading and dispersing, if required, together with a colorant, a charge controller or the like by a kneader or a two-shaft extruder, pulverizing after cooling and then classifying them. Various kinds of materials known as the toner constituent ingredients can be used.

The binder resin for the toner can be selected from a wide variety of materials including known binder resins. There can be mentioned, for example, styrene resin (homo- or copolymer containing styrene or substituted styrene) such as polystyrene, polychlorostyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer (for example, styrene-methyl acrylate copolymer, styrene-ethyl acrylate copolymer, styrene-butyl acrylate copolymer, styreneoctyl acrylate copolymer and styrene-phenyl acrylate copolymer), styrene-methacrylate copolymer (for example, styrene-methyl methacrylate copolymer, styrene-ethyl methacrylate copolymer, styrene-butyl methacrylate copolymer and styrene-phenyl methacrylate copolymer), styrene-methyl α-chloroacrylate copolymer and styrene-acrylonitrile-acrylate copolymer, vinyl chloride resin, rosin modified maleic acid resin, phenolic resin, epoxy resin, saturated or unsaturated polyester resin, low molecular weight polyethylene, low molecular weight polypropylene, ionomer resin, polyurethane resin, silicone resin, ketone resin, ethylene-ethyl acrylate copolymer, xylene resin and polyvinyl butyral resin. As a resin used particularly preferably in the present invention, there can be mentioned, for example, styrene resin, saturated or unsaturated polyester resin and epoxy resin. Further, the above-mentioned resin may be used not only alone but also as a combination of two or more of them.

The magnetic powder for the toner usable in the present invention, there can be mentioned ferromagnetic materials exhibiting ferromagnetism including ferrimagnetism in a working circumstance temperature (around 0° C. to 60° C.) of PPC, etc. For example, there can be mentioned magnetic powder showing ferromagnetism or ferrimagnetism in a temperature range of about 0° C. to about 60° C., selected from magnetite ($Fe_3O_4$), maghemite ($\gamma$-$Fe_2O_3$), an intermediate of magnetite and maghemite, spinel ferrite such as ferrite ($M_xFe_{3-x}O_4$ in which M represents Mn, Fe, Co, Ni, Cu, Mg, Zn, Cd or mixed crystal materials thereof), hexagonal ferrites such as $BaO.6Fe_2O_3$, $SrO.6Fe_2O_3$, garnet-type oxide such as $Y_3Fe_5O_{12}$, $Sm_3Fe_5O_{12}$, rutile-type oxide such as $CrO_2$, metal such as Fe, Mn, Ni, Co and Cr, as well as other ferromagnetic alloys. Among them, a powder of magnetite, maghemite or an intermediate product of magnetite and maghemite within an average particle size of not more than 3 μm, more preferably about 0.05 to 1 μm are preferred in view of the performance and the cost. The above-mentioned magnetic powder may be used not only alone but also as a combination of two or more of them.

As the colorant used for the toner, any of known dyes and pigments such as carbon black, lamp black, iron black, ultramarine, nigrosine dye, aniline blue, phthalocyanine blue, phthalocyanine green, hanza yellow G, rhodamine type dye and pigment, chrome yellow, quinacridone, benzidine yellow, rose bengale, triallylmethane dyes, monoazo and disazo dyes and pigments may be used alone or in admixture.

The addition amount of the colorant into the toner is preferably from 0.1 to 30 parts by weight, more preferably 0.5 to 10 parts by weight based on 100 parts by weight of the binder resin. The fixing property becomes poor, if the amount is excessive, thus showing undesirable tendency.

Charging for the toner may be controlled by the binder resin or the dye and pigment per se and, if required, a charge controller causing no problem in view of the color reproduction may also be used together. As the charge controllers, basic electron donating substance such as a nigrosine dye and a quaternary ammonium salt may be used for a positive charge controller, while acidic and electron attracting substance such as metal chelates or metallized dyes may be used as a negative charge controller while properly selecting them.

The addition amount of the charge controller may be determined, by taking into consideration, the conditions for the manufacturing method including the chargeability of the binder resin, the addition amount of the colorant and the dispersing method, as well as the chargeability of other additives. The amount thereof is preferably from 0.1 to 10 parts by weight based on the 100 parts by weight of the binder resin.

In addition, inorganic particles such as of metal oxides and inorganic substance subjected to a surface treatment by the charge controlling organic substance may also be used.

The charge controller may be used in admixture with the binder resin or being deposited to the surface of toner particles.

In addition, auxiliary agents such as various kinds of plasticizers and releasing agents may also be added to the toner for adjusting thermal property, physical property, etc. The addition amount thereof is preferably from 0.1 to 10 parts by weight based on 100 parts by weight of the toner.

The image-forming particles usually have an electric resistivity of more than $10^{13}$ ohm.cm.

In the present invention, conductive particles are added for improving the resolution power and enhancing the image quality at the black and white boundary. The conductive particles have an average particle size of smaller than that of the image-forming particles and more than 0.1 μm. Even when the average particle size is smaller than that of the image-forming particles, if it contains a considerable amount of agglomerated particles whose size is as several tens times large as that of the image-forming particles, the agglomerated particles tend to cause a failure in the formation of the developer layer on the developer-carrying member. More preferably, particles with the particle size of not more than 3/5 times of that of the image-forming particles are used.

As the material for the conductive particles, there can be mentioned, for example, particles of metals such as Fe, alloys thereof or oxides, for example, magnetite or an intermediate of magnetite and maghemite, spinel ferrite such as ferrite ($M_xFe_{3-x}O_4$ in which M represents Mn, Fe, Co, Ni, Cu, Mg, Zn, Cd or the like or a mixed crystal system thereof), $CrO_2$ and $TiO_2$. Among them, the intermediate of magnetite and maghemite, and Mn—Zn ferrite are preferred. Further, for obtaining an optimum image quality, a treatment for improving the frictional charging property, such as a treatment of increasing or decreasing the conductivity and a hydrophobic treatment may be applied to the surface of the conductive particles.

The electric resistivity of the conductive particles is usually not more than $10^{11}$ ohm.cm, preferably not more than $10^9$ ohm.cm.

The resistivity was measured by packing particles in a cylindrical vessel having a bottom made of an electrode with 20 mm in inner diameter and a circumferential side made of an insulative material, inserting an electrode of 20 mm in diameter from above and applying a voltage at 100 V under a load of about 2 kg. The particles are packed in an amount so as to make the interelectrode distance about 5 mm upon measurement.

There is no particular restriction on the addition amount of the conductive particles but it is preferably added by 1 to 50 parts by weight, more preferably 3 to 30 parts by weight based on 100 parts by weight of the image-forming particles.

As the insulative inorganic oxide particles used in the present invention, particles of silica ($SiO_2$), alumina ($Al_2O_3$), tungsten oxide ($W_2O_3$), zirconium oxide ($ZrO_2$) and selenium oxide (SeO) can be mentioned and particles having a frictional charging property opposite to that of the image-forming particles are used. For instance, negatively chargeable inorganic oxide particles such as silica are used for positively chargeable image-forming particles, whereas positively chargeable inorganic oxide particles such as aluminum are used for negatively chargeable image-forming particles. Particularly, alumina is preferred for negatively chargeable image-forming particles.

The charge polarity can be determined by mixing F-2030 spherical ferrite carrier (manufactured by Powdertech Co, Ltd.) and measuring the blow off charging.

The electric resistivity of the insulative inorganic oxide particles is usually not less than $10^{13}$ ohm.cm.

The insulative inorganic oxide particles preferably have a BET specific surface area of not less than 10 $m^2/g$ more preferably not less than 50 $m^2/g$.

As the material for use in a hydrophobic treatment with silicone to the surface of the insulative inorganic oxide particles, there can be mentioned, for example, polydimethylsiloxane, polymethylphenylsiloxane and alkyl modified silicone.

As a simple method of the surface treatment, silicone is usually mixed at a ratio properly selected from a range of 0.3 to 20 parts by weight, preferably 3 to 15 parts by weight based on 100 parts by weight of a fine inorganic oxide powder depending on the specific surface area of the inorganic oxide paricles or a hydrophobic degree, for example, by a Henschel mixer, thereby coating the surfaces of the paricles. Further, if more uniform surface treatment is necessary, silicone is once dissolved into a solvent such as toluene, xylene or trichloroethylene, then the resultant solution is mixed with inorganic oxide particles, and thereafter the solvent is removed by evaporation under a high temperature.

In addition, inorganic oxide particles may be subjected to a hydrophobic treatment by using a silane coupling agent such as dimethyldichlorosilane or trimethylchlorosilane as disclosed in, for example, Japanese Patent Application Laid-Open (KOKAI) 63-139367(1988) (for example, hydrophobic silica Aerosil R972, manufactured by Degussa Co.), and then further subjected to a silicone treatment.

The addition amount of the particles subjected to the silicone hydrophobic treatment is usually within a range of about 0.05 to 5 parts by weight based on 100 parts by weight of the image-forming particles.

While the fluidity of the developer can be improved by adding the above-mentioned surface-treated inorganic oxides, if the BET specific surface area of the surface treated inorganic oxides is less than 100 $m^2/g$, no desired fluidity can be obtained depending on the case. In such a case, the fluidity may be further improved by adding surface-treated inorganic oxide particles with a BET specific surface area of not less than 100 $m^2/g$.

An addition amount of 0.05 to 2 parts by weight of the surface-treated inorganic oxide particles having the specific surface area of not less than 100 $m^2/g$ based on 100 parts by weight of image-forming particles is usually sufficient.

Further, for obtaining an optimal image characteristic, magnetic particles such as iron particles or ferrite paricles having a particle size greater than that of the image-forming particles may be added.

The developer is usually carried on the developer-carrying member and delivered to a developing region opposed to a latent image-retaining member. Usually, a means for controlling a thickness of the developer layer is disposed to the upstream of the developing region, to control the developing-layer thickness to about 0.1 to 2 mm. More specifically, the thickness of the developer layer increases or decreases periodically accompanying the periodical change of the alternating magnetic field, so that the developer is periodically brought into contact with or apart from the latent image-retaining member or always into contact with the latent image-retaining member and as a result, the pressing force of the developer layer to the latent image-retaining decreases or increases periodically.

In electrophotography, electrostatic recording or the like in which the developing method and the developer according to the present invention are used, the image-forming particles do not transfer to the non-image area and clear images can be formed, as well as unnecessary consumption of the image-forming particles can be suppressed, thereby providing a great industrial merit.

EXAMPLE

Description will now be made more specifically to the present invention. It should, however, be noted that the present invention is not restricted by the following examples and various other modifications are possible unless the scope of the present invention is exceeded.

Example 1

FIG. 1 shows a constitution of an image forming apparatus by a reversal developing system used in this example. Around the circumferential surface of a latent image-retaining member (carrier) 1 comprising a cylindrical aluminum pipe of 30 mmϕ in diameter, coated with an organic photosensitive material (specific dielectric constant: 3) to a thickness of 20 μm, there are arranged a proximity (neighboring) charger 2, an exposure means 3, a developing device 4, a transfer roller 5, and a cleaning means 6 in this order. When the latent image-retaining member 1 rotates at a circumferential speed of 40 mm/sec, it successively passes through each of the processes to form images.

As the proximity charger 2, a cylindrical molding product of 12 mmϕ in diameter made of a conductive rubber comprising EPDM having carbon black dispersed therein (rubber hardness: 80°, according to JIS-K6301A) was used and it was disposed substantially in parallel with the image-retaining member at a distance of about 50 μm from the surface of the image-retaining member. AC at 850 V and 1 KHz of frequency superposed on DC −650 V was applied to the proximity charger, and charges were transferred to the image-retaining member to charge up the member to a surface potential of about −650 V.

A latent image pattern by an electrostatic charge distribution was formed to the image-retaining member by the exposure means 3. 100 parts by weight of a styrene-butyl acrylate-methyl methacrylate copolymer, 3 parts by weight of a low molecular weight polypropylene, 2 parts by weight of a chromium metallized dye and 105 parts by weight of magnetite were blended, kneaded, pulverized and classified to prepare usually negatively chargeable image-forming particles having a volume average particle size of about 8 μm as the image-forming image particles.

One hundred (100) parts by weight of a positively chargeable alumina particles with a BET specific surface area of 50 $m^2/g$ synthesized by a wet process method was subjected to a surface treatment using 10 parts by weight of polydimethylsiloxane. 100 parts by weight of the image-forming particles, 1.5 parts by weight of the treated alumina particles, and 15 parts by weight of Mn—Zn ferrite particles having 1.7 μm of average particle size and at $1\times10^8$ ohm.cm of resistivity as the conductive particles were mixed in a Henschel mixer. The mixture was passed through a mesh of 33 μm nominal size (JIS Z 8801-1982) in a state of being dispersed in air and a coarse powder cut-off developer was prepared and packed in the developing device 4. The developing device 4 had a cylindrical conductive non-magnetic sleeve (developer-carrying member) 9 disposed in parallel with the latent image-retaining member 1 at 0.3 mm in gap and a 6-pole magnet 10 coaxially incorporated in the sleeve 9 and having a maximum magnetization of 600 Gauss on the sleeve 9. The sleeve 9 had 18 mmϕ in diameter and rotated at 75 rpm, while magnet 10 rotated at 500 rpm. The packed developer was delivered by a magnetic force onto the sleeve 9 to form a magnetic brush under control by a control member kept at a distance by 0.2 mm above the sleeve 9 and it was transferred by being in contact with the latent image-retaining member 1. During development, a developing bias of a rectangular wave at 2.2 kV of peak-to-peak level and at 2 kHz of frequency superposed on DC-500 V was applied to the sleeve 9.

As the transfer roller 5, a cylindrical molding product of 12 mmϕ in diameter made of a conductive rubber comprising EPDM having carbon black dispersed therein (rubber hardness: 40°, according to JIS-K6301A) was used and it was rotated while being pressed to the image-retaining member 1 at a circumferential speed identical with that of the latent image-retaining member 1. A voltage was applied at +800 V during a transfer period and switcheably at +800 V and −400 V during a non-transfer period.

As the cleaning means 6, a cleaning blade system comprising a urethane blade in contact with the image support was used for physically scraping off the residual transfer toner.

After passing through the cleaning means, the image support returned again to the process by the proximity charger, and it was processed continuously and simultaneously for each of the processes.

When a continuous printing test was conducted for 10,000 A4-sized sheets of paper by using this apparatus, a satisfactory state of images at high resolution could be kept from the initial stage as far as 10,000 sheets.

Example 2

When a developer was prepared in the same manner as in Example 1 except for using, instead of 1.5 parts of the treated alumina particles synthesized by the wet process, 0.8 parts by weight of alumina particles prepared by treating 100 parts by weight of positively chargeable alumina having a BET specific surface area of 100 $m^2/g$ synthesized by a dry process with 15 parts by weight of polydimethylsiloxane, and a continuous printing test was conducted from the initial stage as far as 5,000 sheets under the same conditions as those in Example 1, a satisfactory state of forming images at high resolution could be kept.

Comparative Example 1

When a test was conducted in the same manner as in Example 1 except for using, instead of the silicone treated alumina particles, 0.4 parts by weight of a negatively chargeable silica particles (BET: 80 $m^2/g$) subjected to a silicone treatment, the image density was reduced about after 1,500 sheets of paper.

Example 3

When a test was conducted in the same manner as in Example 1 as far as 5,000 sheets of paper except for using, instead of Mn—Zn ferrite particles, 5 parts by weight of particles of an intermediate of magnetite and maghemite having an average particle size of 0.3 μm and an electric resistivity of $5\times10^6$ ohm.cm, a satisfactory state of forming images was kept.

Example 4

When a test was conducted in the same manner as in Example 2 as far as 3,000 sheets of paper except for using, instead of Mn—Zn ferrite particles, 15 parts by weight of spherical iron particles having an average particle size of 4 μm, a satisfactory state of forming images was kept.

Example 5

When a test was conducted in the same manner as in Example 2 as far as 3,000 sheets of paper except for using, instead of Mn—Zn ferrite particles having an average particle size of 1.7 μm, 30 parts by weight of Mn—Zn ferrite particles having an average particle size of 3.5 μm and an electric resistivity of $3\times10^8$ ohm.cm, a satisfactory state of forming images was kept.

What is claimed is:

1. An electrostatic developer comprising (1) image-forming particles which are magnetic, (2) conductive particles having an average particle size of not more than that of said image-forming particles and more than 0.1 μm, and (3) particles obtainable by subjecting insulative inorganic oxide particles having a frictional charging polarity opposite to that of said image-forming particles to a hydrophobic treatment with silicone.

2. An electrostatic developer according to claim 1, wherein the insulative inorganic oxide particles are composed of a material selected from the group consisting of alumina, silica, tungsten oxide, zirconium oxide and selenium oxide.

3. An electrostatic developer according to claim 2, wherein the insulative inorganic oxide particles are composed of alumina.

4. An electrostatic developer according to claim 1, wherein the insulative inorganic oxide particles have a BET specific surface area of not less than 50 $m^2/g$.

5. An electrostatic developer according to claim 1, wherein an amount of said particles obtainable by the hydrophobic treatment with silicone is 0.05 to 5 parts by weight based on 100 parts by weight of the image-forming particles.

6. An electrostatic developer according to claim 1, wherein surfaces of the insulative inorganic oxide particles are coated with 0.3 to 20 parts by weight of silicone based on 100 parts by weight of the insulative inorganic oxide particles.

7. An electrostatic developer according to claim 1, wherein the conductive particles are composed of a material selected from group consisting of magnetite, an intermediate of magnetite and maghemite, ferrite, $CrO_2$ and $TiO_2$.

8. An electrostatic developer according to claim 1, wherein an amount of said conductive particles is 3 to 30 parts by weight based on 100 parts by weight of the image-forming particles.

9. An electrostatic developer according to claim 1, wherein the conductive particles have an electric resistivity of not more than $10^9$ ohm.cm.

10. An electrostatic developer according to claim 1, wherein the conductive particles are composed of Mn—Zn ferrite or an intermediate of magnetite and maghemite.

11. An electrostatic developing method comprising opposing a surface of a latent image-retaining member on which an electrostatic latent image is formed, to a surface of a developer-carrying member on which the electrostatic developer as defined in claim 1 is carried; placing the opposed region in an alternating magnetic field, alternating electric field or both thereof which exerts substantially in perpendicular to the surface of the developer-carrying member in said opposed region; and transferring the image-forming particles in the developer onto the latent image-retaining member.

12. An electrostatic developing method according to claim 11, wherein the alternating electric field in the opposed region is formed by applying superposedly a DC voltage and an AC voltage between the latent image-retaining member and the developer-carrying member,

13. An electrostatic developing method according to claim 12, wherein an amplitude of the AC voltage is 400 to 3,000 V and a frequency thereof is 100 Hz to 10 kHz.

14. An electrostatic developing method according to claim 11, wherein the distance between the surfaces of the latent image-retaining member and the developer-carrying member is from 0.15 to 1.5 mm.

15. An electrostatic developing method according to claim 11, wherein a thickness of a developer layer on the developer-carrying member is controlled to 0.1 to 2 mm by a means for controlling the thickness of the developer layer, which is disposed to the upstream of the opposed region in the developer-carrying member.

* * * * *